United States Patent [19]

Mon

[11] Patent Number: 4,678,009

[45] Date of Patent: Jul. 7, 1987

[54] FLUIDIC COMPLEMENTARY GAIN CHANGING CIRCUIT

[75] Inventor: George Mon, Potomac, Md.

[73] Assignee: The United States of America as represented by the Secretary of the Army, Washington, D.C.

[21] Appl. No.: 917,446

[22] Filed: Oct. 3, 1986

[51] Int. Cl.[4] ..... F15C 1/12; F15C 1/08

[52] U.S. Cl. ..... 137/818; 137/819; 137/835; 137/837

[58] Field of Search ..... 137/814, 818, 819, 836, 137/837, 816, 835

[56] References Cited

U.S. PATENT DOCUMENTS

| | | | |
|---|---|---|---|
| 3,199,782 | 8/1965 | Shinn | 137/820 |
| 3,398,759 | 8/1968 | Rose | 137/814 |
| 3,499,460 | 3/1970 | Rainer | 137/819 |
| 3,537,466 | 11/1970 | Chaplin | 137/818 |
| 3,587,602 | 6/1971 | Urbonosky | 137/814 |
| 3,610,265 | 10/1971 | McGuinness | 137/819 |
| 3,708,120 | 1/1973 | Camprubi et al. | 137/819 |
| 3,851,670 | 12/1974 | Ringwall | 137/814 |
| 3,857,412 | 12/1974 | Ringwall | 137/814 |
| 3,926,221 | 12/1975 | Woods | 137/819 |
| 3,986,527 | 10/1976 | Mon | 137/819 |

*Primary Examiner*—A. Michael Chambers

*Attorney, Agent, or Firm*—Saul Elbaum; Guy M. Miller; Thomas E. McDonald

[57] ABSTRACT

A fluidic complementary gain changing circuit has three laminar proportional amplifiers, one of which supplies fluid pressure streams to the other two. The latter amplifiers have substantially identical geometries and complementary gain curves at any given supply pressure, relative to a gain changing signal constituting a bias pressure applied to control ports of the first amplifier. A differential input signal supplied to the control ports of the two complementary amplifiers modulates the supply streams traversing those amplifiers and results in concurrent high and low gain complementary signals at the respective outlet ports of the overall circuit. Variable resistance elements permit calibration of the circuit.

5 Claims, 4 Drawing Figures

FIG.1
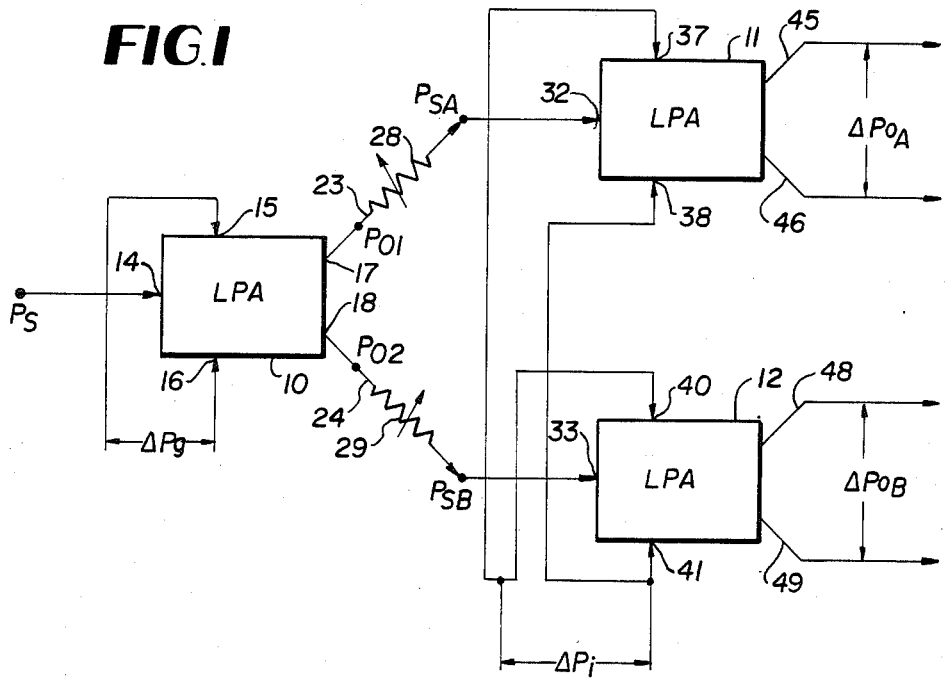
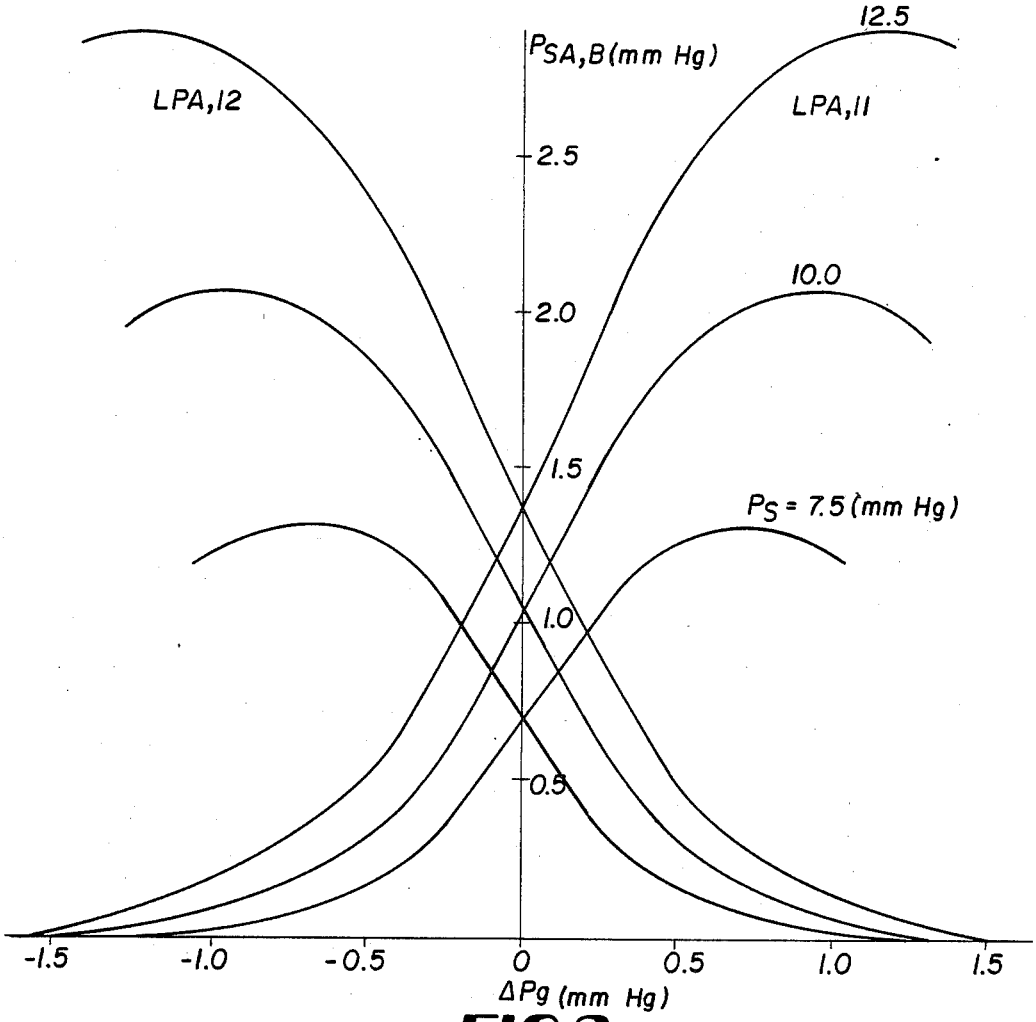
FIG.2

FLUIDIC COMPLEMENTARY GAIN CHANGING CIRCUIT

The invention described herein may be manufactured, used, and licensed by or for the United States Government for governmental purposes without the payment to me of any royalty thereon.

BACKGROUND OF THE INVENTION

The present invention relates generally to pure fluid systems, and more particularly, to a fluidic complementary gain changing circuit.

In the past, gain changing for fluid amplifiers has been achieved using various techniques. One of these involves selective switching among several fluid amplifiers, each having a different gain from the others, according to the specific gain desired for a given application. Another technique requires the selective addition of fluid through a port to an interaction chamber of the fluid amplifier, to vary the gain. Other known techniques include use of a fluidic amplifier cascade, variable area resistor, and fluidic operational amplifier with variable input resistor. Each of these gain changers is of the single push-pull type.

Still another technique, described in U.S. Pat. No. 3,499,460, issued Mar. 10, 1970, to Rainer, involves the use of a pair of identical general purpose proportional fluid amplifiers in a fluidic circuit whose gain is changed by varying the magnitude of a bias pressure common to both amplifiers. A differential pressure signal is produced between output channels of the two amplifiers. If the pressures of the input fluid streams to the amplifiers are equal, and the amplifiers are biased by equal pressures at their respective control ports, the differential output signal between outlet channels of the two amplifiers is zero. A change in the bias pressure at the control ports of the two amplifiers produces a change in the overall circuit's differential output signal, and thus may be used to vary the fluidic circuit gain. Accordingly, the differential pressure (input signal) applied to the control ports of a third proportional fluid amplifier that supplies differential output pressures as input supply pressures to the other two amplifiers, is amplified or not according to the selected gain of the overall circuit.

For some applications, it is desirable to provide a complementary gain changing function in a fluidic circuit, which is not achievable using any of the aforementioned techniques. In particular, the capability to provide simultaneous dual outputs of high and low gain is a desirable feature for the fluidic flight control systems of certain aircraft, such as a vertical/standard take-off and landing (V/STOL) aircraft.

Accordingly, it is a principal object of the present invention to provide a pure fluidic complementary gain changing circuit.

Another general object of the invention is to provide a fluidic complementary gain changer in which the fluidic circuit gain is selectively adjustable such that complementary outputs are derived from opposite gain extremes ranging upward to approximately one hundred percent versus a concurrent zero percent.

SUMMARY OF THE INVENTION

Briefly, these and other objects, features and advantages of the invention are attained in a fluidic circuit comprising, in a presently preferred embodiment, three laminar proportional amplifiers and two variable resistors. Differential outlet pressures of one of the amplifiers provide respect supply pressures to the other two amplifiers, and the variable resistors are interposed in the respective supply lines to the latter amplifiers to permit adjustment, equalization, or other desired calibration of the supply pressures to those amplifiers. Separate differential output pressures at the outlet channels of the two amplifiers are derived from signals subjected to complementary pressure gains, and the overall fluidic circuit gain may be adjusted by the differential pressure applied to the control ports of the input amplifier.

BRIEF DESCRIPTION OF THE DRAWINGS

The above and still further objects, features and advantages of the invention will become apparent from the ensuing detailed description of a presently preferred embodiment, taken in conjunction with the accompanying drawings in which:

FIG. 1 is a schematic diagram of the presently preferred embodiment of a pure fluid complementary gain changing circuit according to the invention;

FIG. 2 is a chart of supply pressure to each of the complementary fluidic amplifiers versus the differential gain changing signal applied to the input amplifier, for various supply pressures to the input amplifier;

DESCRIPTION OF THE PREFERRED EMBODIMENT

Figure 4:
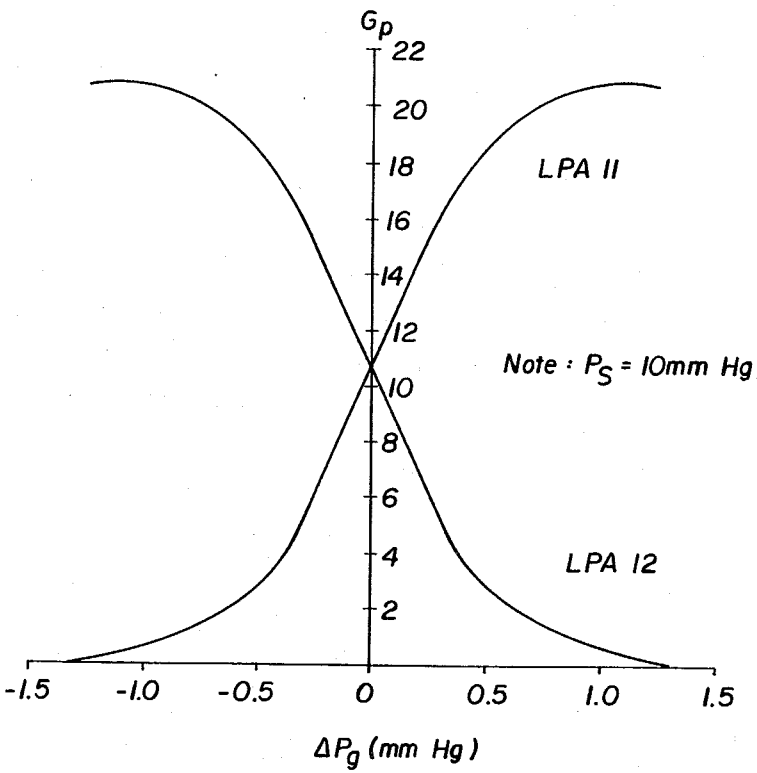
FIG. 4 is a chart showing the complementary pressure gains of the laminar proportional amplifiers versus the magnitude of the differential gain changing signal applied to the input laminar proportional amplifier, for a given supply pressure to the input amplifier.

With reference now to FIG. 1, a fluidic complementary gain changing circuit comprises three laminar proportional amplifiers (LPAs) 10, 11, and 12. A laminar flow element, such as each of 10, 11, 12, is to be contrasted with a turbulent flow element in that the latter is configured in a manner to assure that the supply stream, consisting of a high energy stream of fluid (typically, air), applied to an input port or power nozzle of the element, will, upon appropriate bias pressures applied to one or more control ports of the element, attach itself to one of a plurality of (typically, two) walls within the element. In contrast, the laminar flow element is configured to prevent the supply stream from attaching itself to a channel wall, but rather to deflect the stream through one or more channels in proportion to the pressure difference (bias) across that supply stream. For that reason, elements 10, 11 and 12 are termed laminar (or laminar flow) proportional amplifiers.

LPA 10 has an input port 14 to a power nozzle, via which an input supply stream $P_s$ is applied to the amplifier, and a pair of control ports 15 and 16 via which a differential gain changing signal $\Delta P_g$ is applied as a bias pressure across the supply stream $P_s$ as the latter traverses through the amplifier element. Output pressures $P_{o1}$ and $P_{o2}$ are derived at output channels 17 and 18 of LPA 10 as a result of this action on stream $P_s$ within the amplifier element. These outputs channels are coupled respectively to each of LPAs 11 and 12 by way of channels 23 and 24, which contain variable resistance elements 28 and 29, respectively.

Channel 23 is coupled to an input port 32 of LPA 11 and channel 24 is coupled to an input port 33 of LPA 12. LPAs 11 and 12 are configured with substantially identical geometries. Each of LPAs 11 and 12 has a pair of control ports, 37 and 38 for the former and 40 and 41 for the latter, for applying a differential input signal as a bias pressure across the supply stream ($P_{sA}$ and $P_{sB}$) entering the respective input port of those amplifiers. In the fluidic circuit of FIG. 1, the same differential input signal, $\Delta P_i$, is applied to each of amplifiers 11 and 12.

Finally, each of LPAs 11 and 12 has a pair of outlet channels, 45 and 46 for the former, and 48 and 49 for the latter. The differential output pressure present across outlet channels 45, 46 of LPA 11 is $\Delta P_{oA}$, and the differential output pressure appearing across the two outlet channels 48, 49 of LPA 12 is $\Delta P_{oB}$.

In the operation of the fluidic circuit of FIG. 1, in the absence of any differential pressure between control ports 15 and 16 of LPA 10 (i.e., $\Delta P_g=0$), the supply stream $P_s$ applied to input port 14 of that amplifier will divide evenly through output channels 17 and 18. As a result, the output pressures $P_{o1}$ and $P_{o2}$ at those respective output channels will be equal in those circumstances. However, if a non-zero differential pressure $\Delta P_g$ is applied between control ports 15 and 16, then the output pressures $P_{o1}$ and $P_{o2}$ will correspond to the degree to which the supply stream $P_s$ is deflected through each of channels 17 and 18, respectively. That is, the output pressures $P_{o1}$ and $P_{o2}$ will be proportional to the pressure difference across the supply stream $P_s$ attributable to the differential pressure signal $\Delta P_g$.

Variable resistance elements 28 and 29 in channels 23 and 24, respectively, are utilized to adjust the pressures in those two channels as desired for calibration purposes. In particular, with no differential pressure $\Delta P_g$ across control ports 15 and 16, the resistance elements 28 and 29 may be individually adjusted such that the supply pressures $P_{sA}$ and $P_{sB}$ to LPAs 11 and 12 respectively, are substantially equal.

In the absence of a differential input pressure $\Delta P_i$ across control ports 37 and 38 of LPA 11, the supply pressure $P_{sA}$ to input port 32 will split evenly into the outlet channels 45 and 46, and the differential output pressures $\Delta P_{oA}$ will therefore be zero. Similarly, in the absence of a differential input pressure $\Delta P_i$ across control ports 40 and 41 of LPA 12, the supply pressur $P_{sB}$ applied to that amplifier via input port 33 will divide evenly between outlet channels 48 and 49, and the output pressure $\Delta P_{oB}$ across those outlet channels will therefore be zero.

Referring now to the graph of FIG. 2, the supply pressures $P_{sA}$, $P_{sB}$ are plotted versus the differential gain changing signal $\Delta P_g$ (both measured in terms of millimeters of mercury, mm. Hg), for various supply stream pressures $P_s$ applied to the input port of LPA 10. It will readily be observed that $P_{sA}$ and $P_{sB}$, as a function of $\Delta P_g$, are complementary to each other for any given value of $P_s$. For example, if supply pressure $P_s$ is equal to 7.5 mm. Hg, $P_{sA}$ is at approximately 1.3 mm. Hg and $P_{sB}$ is at approximately 0.05 mm. Hg, when $\Delta P_g$ is at about 0.7 mm. Hg; and the precisely opposite values for $P_{sA}$ and $P_{sB}$ are present when $\Delta P_g$ is a negative 0.7 mm. Hg. Thus $P_{sA}$ and $P_{sB}$ constitute separate fluid supply streams, each of which conforms to a variable pressure curve constituting the complement of the other relative to $P_s$ and $\Delta P_g$.

Figure 3:
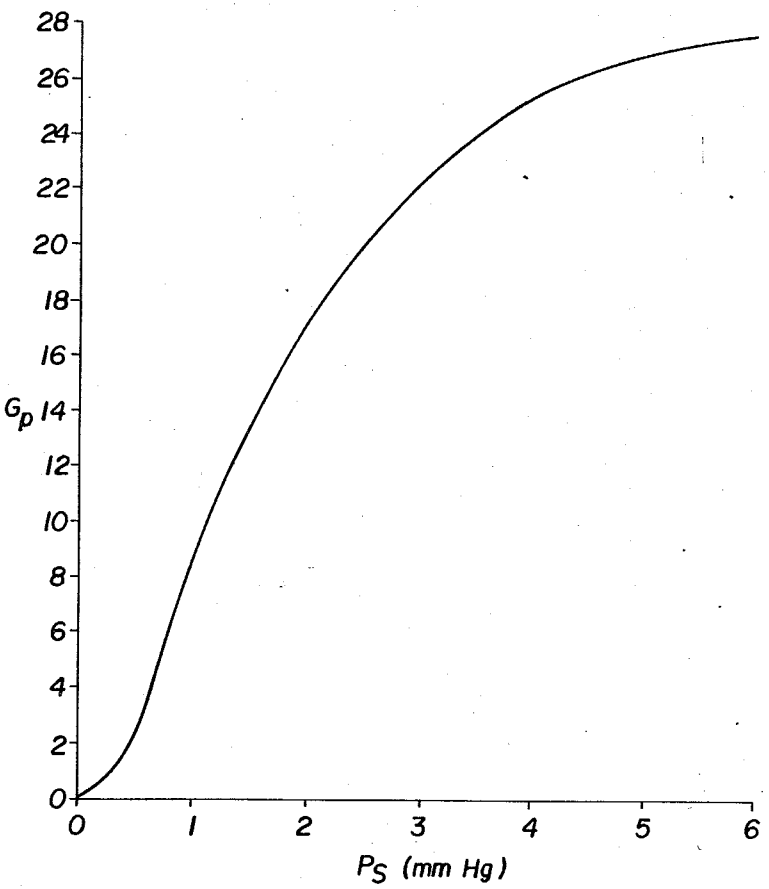
FIG. 3 is a chart showing a typical gain characteristic of a laminar proportional amplifier.

As shown in FIG. 3, the pressure gain $G_p$ of a laminar proportional amplifier is a function of the supply stream pressure ($P_s$, $P_{sA}$ or $P_{sB}$, as the case may be), with the shape of the curve being typical of the LPA. It will be appreciated, then, that the pressure gains of LPA 11 and LPA 12 are complementary to each other; and, indeed, this is apparent from the graph of FIG. 4, illustrating the pressure gain $G_p$ versus differential gain changing signal $\Delta P_g$ for a supply pressure to each LPA equal to 10 mm. Hg. It will further be observed from FIG. 3 that when the gain of LPA 11 is at a maximum, the gain of LPA 12 is close to a minimum. Accordingly, the fluidic complementary gain changing circuit of FIG. 1 has the capability to provide a virtually one hundred percent gain at the high gain extreme for one LPA (11 or 12) concurrently with a virtually zero percent gain at the low gain extreme for the other LPA.

Returning to FIG. 1, assume now, that the supply stream pressure $P_s$ into LPA 10 via inlet port 14 is 10 mm. Hg, and that the gain changing signal $\Delta P_g$ is of such magnitude that LPA 10 is in saturation. In this particular instance, assume that the pressure introduced at control port 16 is sufficiently high relative to the pressure at control port 15 that the saturation is manifested by the supply stream being forced to flow exclusively in outlet channel 17.

The variable resistance fluidic elements 28 and 29 have been adjusted previously to calibrate the overall fluidic complementary gain changing circuit. Hence, if the output pressures of fluid streams exiting channels 17 and 18 were equal (i.e., $P_{o1}=P_{o2}$), then the supply streams entering LPA 11 and LPA 12 would also be equal (i.e., $P_{sA}=P_{sB}$). In this particular example, however, with the condition of saturation of LPA 10, the supply pressure $P_{sA}$ to LPA 11 is at a maximum while $P_{sB}$ to LPA 12 is at a minimum. This corresponds to the condition in the graph of FIG. 2 for the curve of supply pressure ($P_{sA,\,B}$) versus $\Delta P_g$ in which $P_s=10$ mm. Hg, with $\Delta P_g$ at approximately 1.0 mm. Hg. As will be seen from FIG. 4, in these circumstances, the pressure gain $G_p$ of LPA 11 is approximately 21 while the pressure gain of LPA 12 is near zero (actually, about 0.5). Thus, the differential input pressure signal $\Delta P_i$ supplied to the control ports of the two LPAs undergoes maximum amplification by modulating the supply stream via LPA 11, whereas it is virtually undetectable at the outlet port of LPA 12.

This capability to attain virtually one hundred percent of the gain of the overall circuit at the high-gain extreme for one of the two complementary LPAs (in this example, LPA 11) at the same time that the other complementary LPA (12, in this case) is at a low-gain extreme of about zero percent gain, is extremely desirable for such applications as in fluidic flight control systems for V/STOL aircraft. In particular, that capability allows the V/STOL aircraft to change from hovering to conventional flight without cross-axis coupling at the extreme flight conditions.

I wish it to be understood that I do not desire to be limited to the exact details of construction shown and described, for obvious modifications can be made by a person skilled in the art.

I claim:

1. A laminar flow fluidic complementary gain changing circuit comprising:

A first laminar proportional amplifier having a supply stream input port connected to a fluid pressure supply, a first control stream input port, a second control stream input port, a first output port and a second output port;

bias means connected to the first and second control stream input ports of said first laminar proportional amplifier for supplying a differential pressure signal therebetween;

a second laminar proportional amplifier having a supply stream input port, a first control stream input port, a second control stream input port, a first output port and a second output port;

first channel means for connecting the first output port of said first laminar proportional amplifier to the supply stream input of said second laminar proportional amplifier;

a third laminar proportional amplifier having a supply stream input port, a first control stream input port, a second control stream input port, a first output port and a second output port;

second channel means for connecting the second output port of said first laminar proportional amplifier to the supply stream input of said third laminar proportional amplifier;

third channel means for connecting the first control stream input port of said second laminar proportional amplifier with said first control stream input port of said third laminar proportional amplifier;

fourth channel means for connecting the second control steam input port of said second laminar proportional amplifier with said second control stream input port of said third laminar proportional amplifier, whereby said third and fourth channel means receive differential input pressure signals therebetween so that a first differential output signal is produced between the first and second output ports of said second laminar proportional amplifier and a second differential output signal is produced between the first and second output ports of said third laminar proportional amplifier, the magnitude of the first and second differential output signals being complementary to one another with pressure gains a function of the differential pressure signal supplied to the first and second control stream input ports of said first laminar proportional amplifier.

2. The fluidic circuit of claim 1 wherein said first channel means comprises;

first restricting means for variably restricting fluid flow from said first output port of said first laminar proportional amplifier to the supply stream input port of said second laminar proportional amplifier.

3. The fluidic circuit of claim 2 wherein said second channel means comprises;

second restricting means for variably restricting fluid flow said second output port of said first laminar proportional amplifier to the supply stream input port of said third laminar proportional amplifier.

4. The fluidic circuit of claim 3 wherein said first restricting means comprises;

a first variable fluidic resistor.

5. The fluidic circuit of claim 4 wherein said second restricting means comprises;

a second variable fluidic resistor.

* * * * *